US009886902B2

(12) United States Patent
Park et al.

(10) Patent No.: US 9,886,902 B2
(45) Date of Patent: Feb. 6, 2018

(54) ORGANIC LIGHT EMITTING DISPLAY DEVICE

(71) Applicant: SAMSUNG DISPLAY CO., LTD., Yongin-si, Gyeonggi-do (KR)

(72) Inventors: Kyong-Tae Park, Yongin-si (KR); Tae-Gon Kim, Yongin-si (KR); Dong-Yoon So, Yongin-si (KR); Sung-Ho Cho, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 155 days.

(21) Appl. No.: 14/829,510

(22) Filed: Aug. 18, 2015

(65) Prior Publication Data

US 2016/0104421 A1 Apr. 14, 2016

(30) Foreign Application Priority Data

Oct. 13, 2014 (KR) ..... 10-2014-0137623

(51) Int. Cl.
*G09G 3/32* (2016.01)
*G09G 3/3233* (2016.01)
*G09G 3/3225* (2016.01)

(52) U.S. Cl.
CPC ..... *G09G 3/3233* (2013.01); *G09G 3/3225* (2013.01); *G09G 2300/0413* (2013.01); *G09G 2300/0814* (2013.01); *G09G 2300/0819* (2013.01); *G09G 2300/0852* (2013.01); *G09G 2300/0861* (2013.01); *G09G 2330/08* (2013.01)

(58) Field of Classification Search
CPC ..... G09G 3/3233; G09G 3/3225; G09G 2300/0413; G09G 2330/08
See application file for complete search history.

(56) References Cited

U.S. PATENT DOCUMENTS 7,868,859 B2 * 1/2011 Tomida ..... G09G 3/3233 345/76
9,256,109 B2 * 2/2016 Kang ..... G09G 3/20
2007/0035687 A1 2/2007 Oke et al.
(Continued)

FOREIGN PATENT DOCUMENTS

KR 10-0666639 B1 1/2007
KR 10-2007-0019553 A 2/2007

*Primary Examiner* — Abbas Abdulselam
(74) *Attorney, Agent, or Firm* — Lewis Roca Rothgerber Christie LLP

(57) ABSTRACT

An organic light emitting display device, includes: pixels connected to scan lines, light emission lines, and data lines crossing the scan lines and the light emission lines, and including organic light emitting diodes, and pixel driving circuits to output a driving current to the organic light emitting diodes, respectively; a plurality of dummy driving circuits to output a dummy driving current; a dummy data line to apply a dummy data voltage to the plurality of dummy driving circuits; and a plurality of repair lines to electrically connect each of the organic light emitting diodes to at least one of the plurality of dummy driving circuits, wherein each of the dummy driving circuits corresponds to at least two of the repair lines, and each of the organic light emitting diodes is to be electrically connected to corresponding ones of the dummy driving circuits through corresponding ones of the repair lines.

10 Claims, 6 Drawing Sheets

(56) References Cited

U.S. PATENT DOCUMENTS

| | | | | |
|---|---|---|---|---|
| 2008/0084365 | A1* | 4/2008 | Takahara | G09G 3/006 345/76 |
| 2016/0035811 | A1* | 2/2016 | Choi | H01L 51/5221 257/72 |
| 2016/0104430 | A1 | 4/2016 | Park | |

* cited by examiner

ORGANIC LIGHT EMITTING DISPLAY DEVICE

CROSS REFERENCE TO RELATED APPLICATION

This application claims priority to and the benefit of Korean Patent Application No. 10-2014-0137623, filed on Oct. 13, 2014, in the Korean Intellectual Property Office, the entire contents of which are incorporated herein by reference in their entirety.

BACKGROUND

1. Field

One or more exemplary embodiments of the present invention relate to an organic light emitting display device including a plurality of pixels, each of which includes an organic light emitting diode and a driving circuit for outputting a driving current to the organic light emitting diode.

2. Description of the Related Art

As an information-oriented society has been developed, demand for a display device for displaying an image has increased in various forms, and recently, various flat panel display devices, such as a liquid crystal display device, a plasma display panel, and an organic light emitting display device, have been utilized.

The organic light emitting display device among the flat panel display devices includes a plurality of scan lines for applying scan signals, a plurality of light emission lines corresponding to the plurality of scan lines, a plurality of data lines crossing the plurality of scan lines and the plurality of light emission lines, and a plurality of pixels, each of which includes an organic light emitting diode and a pixel driving circuit for outputting a driving current to the organic light emitting diode.

The above information disclosed in this Background section is only for enhancement of understanding of the background of the invention and therefore it may contain information that does not form the prior art that is already known to a person of ordinary skill in the art.

SUMMARY

According to an exemplary embodiment of the present invention, an organic light emitting display device includes: scan lines, light emission lines, and data lines crossing the scan lines and the light emission lines; a plurality of pixels connected to the scan lines, the light emission lines, and the data lines, the plurality of pixels including organic light emitting diodes, and pixel driving circuits configured to output a driving current to the organic light emitting diodes, respectively; a plurality of dummy driving circuits configured to output a dummy driving current; a dummy data line configured to apply a dummy data voltage to the plurality of dummy driving circuits; and a plurality of repair lines configured to electrically connect each of the organic light emitting diodes to at least one of the plurality of dummy driving circuits, wherein each of the dummy driving circuits corresponds to at least two of the repair lines, and each of the organic light emitting diodes is configured to be electrically connected to corresponding ones of the dummy driving circuits through corresponding ones of the repair lines.

The plurality of repair lines may correspond to the scan lines, respectively, and the at least two of the repair lines corresponding to each of the dummy driving circuits may be adjacent to each other.

Each of the dummy driving circuits may be configured to receive the dummy data voltage at one timing from among timings during which a scan signal is applied to corresponding ones of the scan lines, and a voltage level of the dummy data voltage may correspond to a voltage level of a data line electrically connected to an erroneously operated pixel driving circuit.

Each of the dummy driving circuits may be configured to receive the dummy data voltage at a last timing from among timings during which a scan signal is applied to corresponding ones of the scan lines, and a current level of the dummy driving current may correspond to a voltage level of the dummy data voltage.

A corresponding organic light emitting diode may be electrically disconnected from an erroneously operated pixel driving circuit; the corresponding organic light emitting diode may be electrically connected to a corresponding dummy driving circuit via a corresponding repair line; the corresponding organic light emitting diode may be configured to emit light according to a dummy driving current output by the corresponding dummy driving circuit; and the corresponding repair line and the corresponding dummy driving circuit may be electrically connected to each other by laser irradiation.

Each of the dummy driving circuits may correspond to two of the repair lines, and each of the dummy driving circuits may include: a dummy pixel driving circuit configured to output a current of which a level corresponds to a voltage level of the dummy data voltage; a compensation circuit configured to compensate for a current variation by parasitic capacitance by corresponding ones of the repair lines; and an output node configured to output the dummy driving current, wherein the output node may be electrically connected to the dummy pixel driving circuit and the compensation circuit.

The dummy pixel driving circuit may include: a driving transistor including a gate electrode connected to a first node, a first electrode connected to a second node, and a second electrode connected to a third node; a first transistor including a gate electrode connected to a first scan line from among the scan lines, a first electrode connected to the first node, and a second electrode connected to the third node; a second transistor including a gate electrode connected to the first scan line, a first electrode connected to the dummy data line, and a second electrode connected to the second node; a third transistor including a gate electrode connected to a second scan line from among the scan lines, a first electrode connected to the first node, and a second electrode configured to receive a first initialization power voltage; a fourth transistor including a gate electrode connected to a first light emission line from among the light emission lines, a first electrode configured to receive a high potential voltage, and a second electrode connected to the second node; a fifth transistor including a gate electrode connected to the first light emission line, a first electrode connected to the third node, and a second electrode connected to the output node; and a capacitor including one end connected to the first node, and another end configured to receive the high potential voltage, wherein the first light emission line may correspond to the first scan line, and a scan signal may be applied to the first scan line after the scan signal is applied to the second scan line.

The compensation circuit may include: a sixth transistor including a gate electrode connected to a third light emission line from among the light emission lines, a first electrode configured to receive a high potential compensation voltage, and a second electrode connected to a fifth node; a seventh transistor including a gate electrode connected to a third scan line from among the scan lines, a first electrode connected to the fifth node, and a second electrode configured to receive a low potential compensation voltage; an eighth transistor including a gate electrode connected to the fifth node, a first electrode connected to the output node, and a second electrode configured to receive a second initialization power voltage; and a compensation capacitor including one end connected to the fifth node, and another end configured to receive the high potential compensation voltage, wherein a light emission signal is applied to the third light emission line after the light emission signal is applied to a light emission line electrically connected to a corresponding dummy pixel driving circuit, and a scan signal is applied to a scan line electrically connected to the corresponding dummy pixel driving circuit after the scan signal is applied to the third scan line.

The first scan line may correspond to a repair line from among the repair lines to which the scan signal may be applied last within one frame.

The dummy data line may be configured to be floated, or to apply a dummy data voltage having a black voltage level, at which light emission by the corresponding organic light emitting diode may be stopped, to the corresponding dummy driving circuit, after the corresponding dummy driving circuit outputs the dummy driving current to the corresponding organic light emitting diode.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the spirit and scope of the present invention to those skilled in the art.

In the drawing figures, dimensions may be exaggerated for clarity of illustration. Like reference numerals refer to like elements throughout.

DETAILED DESCRIPTION

Figure 1A:
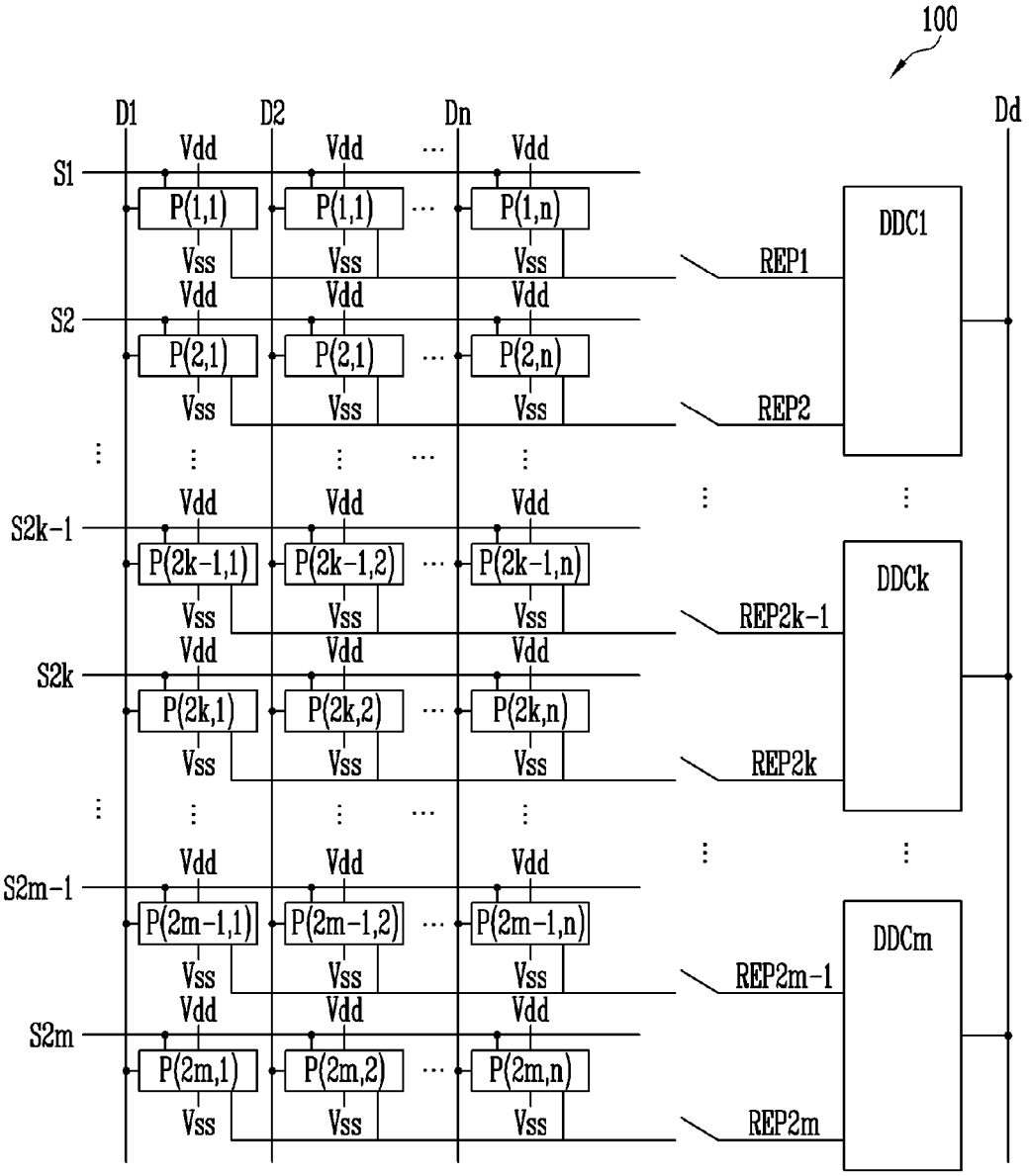
FIG. 1A is a diagram illustrating an organic light emitting display device according to an exemplary embodiment of the present invention.

Hereinafter, exemplary embodiments of the present invention will be described in more detail with reference to the accompanying drawings. Like reference numerals principally refer to like elements throughout the specification. In the following description, when the detailed description of the relevant known function or configuration is determined to unnecessarily obscure aspects and features of the present invention, the detailed description is not provided. Accordingly, processes, elements, and techniques that are not necessary to those having ordinary skill in the art for a complete understanding of the aspects and features of the present invention are not described with respect to some of the embodiments of the present invention. Further, a name of a constituent element used in the description below may be selected in consideration of easiness of writing the specification, and thus, may be different from a name of a component of an actual product.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section.

Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise.

It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 1B:
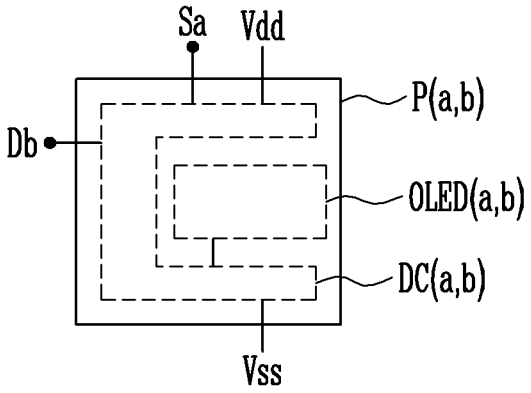
FIG. 1B is a diagram illustrating a pixel of the organic light emitting display device illustrated in FIG. 1A.

FIG. 1A is a diagram illustrating an organic light emitting display device according to an exemplary embodiment of the present invention, and FIG. 1B is a diagram illustrating a pixel in the organic light emitting display device illustrated in FIG. 1A. Referring to FIG. 1A, an organic light emitting display device 100 includes a plurality of scan lines S1 to S2*m*, a plurality of data lines D1 to Dn crossing the plurality of scan lines S1 to S2*m*, a plurality of pixels P(1,1) to P(2*m*,*n*), a plurality of dummy driving circuits DDC1 to DDCm, a dummy data line Dd, and a plurality of repair lines REP1 to REP2*m*. For convenience of illustration and description, a plurality of light emission lines corresponding to the plurality of scan lines S1 to S2*m*, respectively, is omitted, and will be described with reference to the drawings below. Referring to FIG. 1B, a pixel P(a,b) includes an organic light emitting diode OLED(a,b), and a pixel driving circuit DC(a,b) for outputting a driving current to the organic light emitting diode OLED(a,b).

Scan signals may be applied through the plurality of scan lines S1 to S2*m* in a sequence of indexes (1 to 2*m*). For example, the scan signals may be applied sequentially to the scan lines S1 to S2*m*. The plurality of repair lines REP1 to REP2*m* corresponds to the plurality of scan lines S1 to S2*m*, respectively, and is disposed to be electrically connected with the plurality of pixels P(1,1) to P(2*m*,*n*) when laser is irradiated. The dummy driving circuit DDCk (k is a positive integer) may correspond to two repair lines REP2*k*−1 and REP2*k*, and may be electrically connected to at least one of the two repair lines REP2*k*−1 and REP2*k*.

For convenience of the description, one pixel P(a,b) (a and b are positive integers) among the pixels will be described. The pixel driving circuit DC(a,b) within the pixel P(a,b) is electrically connected with an $a^{th}$ scan line Sa and a $b^{th}$ data line Db. A high potential voltage $V_{dd}$ and a low potential voltage $V_{ss}$ are applied to the pixel driving circuit DC(a,b). A current level of a driving current output by the pixel driving circuit DC(a,b) is determined based on a voltage level of the $b^{th}$ data line Db.

In order to describe functions of the plurality of dummy driving circuits DDC1 to DDCm, the plurality of repair lines REP1 to REP2*m*, and the dummy data line Dd, it is assumed that the pixel driving circuit DC(2*m*-1,1) is erroneously operated. Since the pixel driving circuit DC(2*m*-1,1) is erroneously operated, an organic light emitting diode OLED (2*m*-1,1) (e.g., a corresponding organic light emitting diode) corresponding to the pixel driving circuit DC(2*m*-1,1) and the pixel driving circuit DC(2*m*-1,1) are electrically disconnected. Instead, the organic light emitting diode OLED(2*m*-1,1) is electrically connected to a repair line REP2*m*-1 (a corresponding repair line) by laser irradiation, and an $m^{th}$ dummy driving circuit DDCm (a corresponding dummy driving circuit) corresponding to the pixel driving circuit DC(2*m*-1,1) is electrically connected to the corresponding organic light emitting diode OLED(2*m*-1,1) through the corresponding repair line REP2*m*-1. Otherwise, all of the organic light emitting diodes and all of the repair lines may already have been electrically connected. The dummy data line Dd applies a dummy data voltage to the corresponding dummy driving circuit DDCm. The corresponding dummy driving circuit DDCm outputs a dummy driving current to the organic light emitting diode OLED(2*m*-1,1), and a current level of the dummy driving current is determined based on a voltage level of the dummy data voltage. The voltage level of the dummy data voltage corresponds to a voltage level Vdata(2*m*-1,1) of the data voltage applied to the pixel P(2*m*-1,1), so that the pixel P(2*m*-1,1) may emit light with intended brightness by the dummy driving current output by the corresponding dummy driving circuit DDCm, even though the pixel driving circuit DC(2*m*-1,1) is erroneously operated. However, because of a parasitic capacitance and the like by the repair line REP2*m*-1, a timing, at which the pixel driving circuit DC(2*m*-1,1) starts to output a driving current, is different from a timing, at which the $m^{th}$ dummy driving circuit DDCm starts to output the dummy driving current. Accordingly, a timing, at which the pixel P(2*m*-1,1) starts to emit light by the dummy driving current output by the $m^{th}$ dummy driving circuit DDCm, is delayed compared to a timing, at which the pixel P(2*m*-1,1) starts to emit light by the driving current output by the pixel driving circuit DC(2*m*-1,1). However, the delay is sufficiently shorter than a time for which one frame is displayed, so that the delay may not be identified with naked eyes.

In the exemplary embodiment illustrated in FIG. 1, each dummy driving circuit DDCk (k is a positive integer) may be electrically connected with two repair lines REP2*k*−1 and REP2*k*, so that 2*m* scan lines S1 to S2*m* correspond to m dummy driving circuits DDC1 to DDCm. The number of dummy driving circuits is less than the number of scan lines, so that an area occupied by the dummy driving circuits may be decreased. A timing, at which the pixel P(2*m*,1) starts to emit light by the dummy driving current output by the $m^{th}$ dummy driving circuit DDCm, is also delayed when compared to a timing at which the pixel P(2*m*,1) starts to emit light by the driving current output by the pixel driving circuit DC(2*m*-1,1), but the delay is sufficiently shorter than the time for which one frame is displayed, so that the delay may not be identified with naked eyes.

Figure 2:
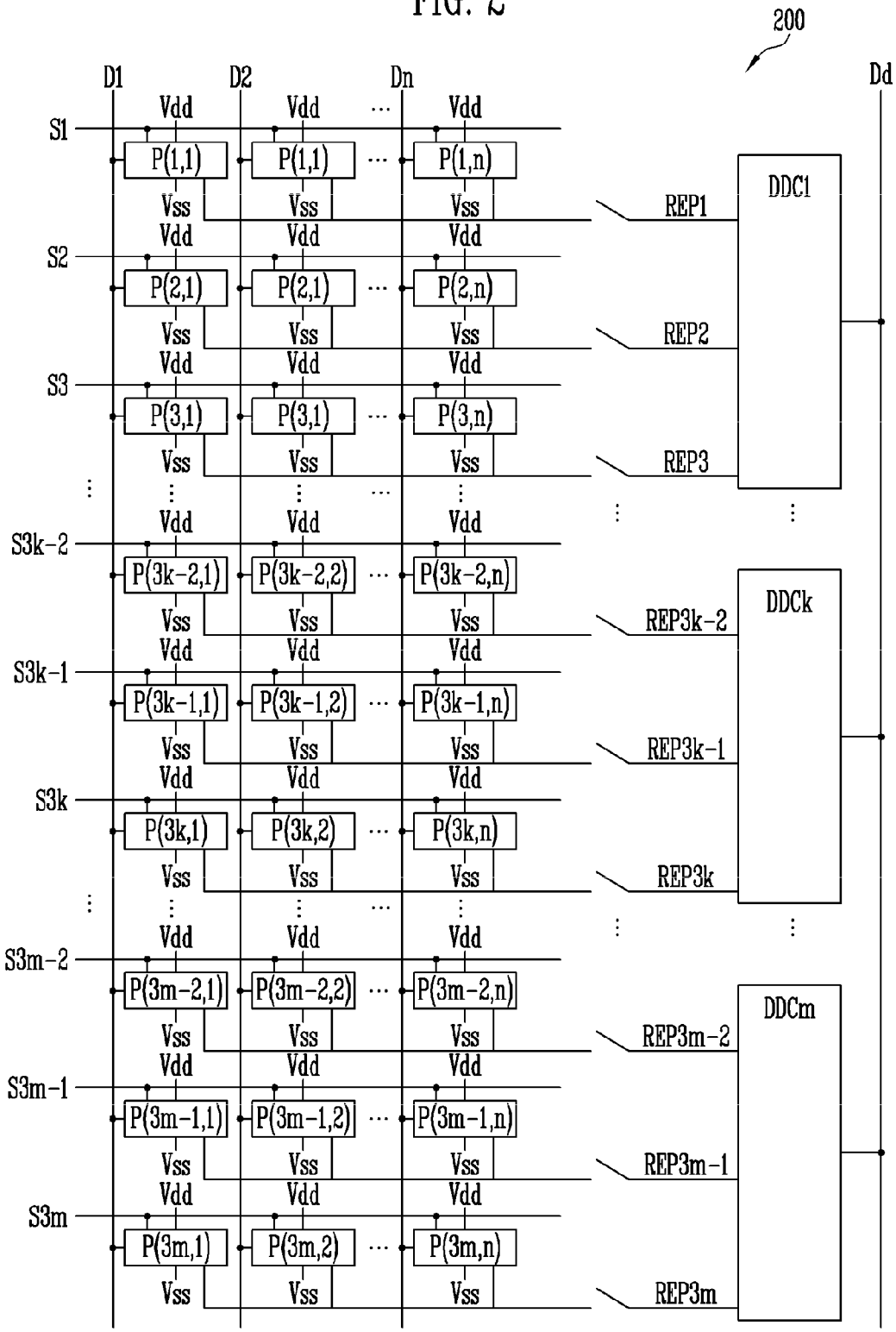
FIG. 2 is a diagram illustrating an organic light emitting display device according to another exemplary embodiment of the present invention.

FIG. 2 is a diagram illustrating an organic light emitting display device according to another exemplary embodiment of the present invention. An organic light emitting display device 200 is substantially similar to the organic light emitting display device 100, and detailed structures of respective pixels P(1,1) to P(3*m*,*n*) are substantially similar to those illustrated in FIG. 1B, so that descriptions thereof will be omitted.

A dummy driving circuit DDCk (k is a positive integer) corresponds to three repair lines REP3*k*−2, REP3*k*−1, and REP3*k*, and the corresponding repair lines REP3*k*−2, REP3*k*−1, and REP3*k* are adjacent to one another. Further, the dummy driving circuit DDCk may be connected to any one among scan lines S3*k*−2, S3*k*−1, and S3*k* corresponding to the repair lines REP3*k*−2, REP3*k*−1, and REP3*k*. For example, the dummy driving circuit DDCk may receive a scan signal from the scan line S3*k*, and when a transistor within the dummy driving circuit DDCk is turned on by the scan signal, the dummy driving circuit DDCk may receive a dummy data voltage from a dummy data line Dd.

When it is assumed that a pixel driving circuit DC(3*m*-2,1) is erroneously operated, a corresponding dummy driving circuit DDCm supplies a dummy driving current to a corresponding organic light emitting diode OLED(3*m*-2,1). A current level of the dummy driving current is determined based on a voltage level of a dummy data voltage. The voltage level of the dummy data voltage corresponds to a voltage level Vdata(3*m*-2,1) of the data voltage applied to a data line D1 when a scan signal is applied to a scan line S3*m*-2, so that the pixel P(3*m*-2,1) may emit light with intended brightness by the dummy driving current output by the corresponding dummy driving circuit DDCm, even though the pixel driving circuit DC(3*m*-2,1) is erroneously operated. Similar to the exemplary embodiment described with reference to FIG. 1A, a timing, at which the pixel P(3*m*-2,1) starts to emit light by the dummy driving current output by the corresponding dummy driving circuit DDCm, is also delayed when compared to a timing at which the pixel P(3*m*-2,1) starts to emit light by the driving current output by the pixel driving circuit DC(3*m*-1,1), but the delay by the driving of the $m^{th}$ dummy driving circuit DDCm is sufficiently shorter than the time for which one frame is displayed, so that the delay may not be identified with naked eyes. Similar to the exemplary embodiment illustrated in FIG. 1A, the number of dummy driving circuits for replacing the erroneously operated pixel driving circuits is decreased, so that an area for disposing the dummy driving circuits is decreased.

Figure 3:
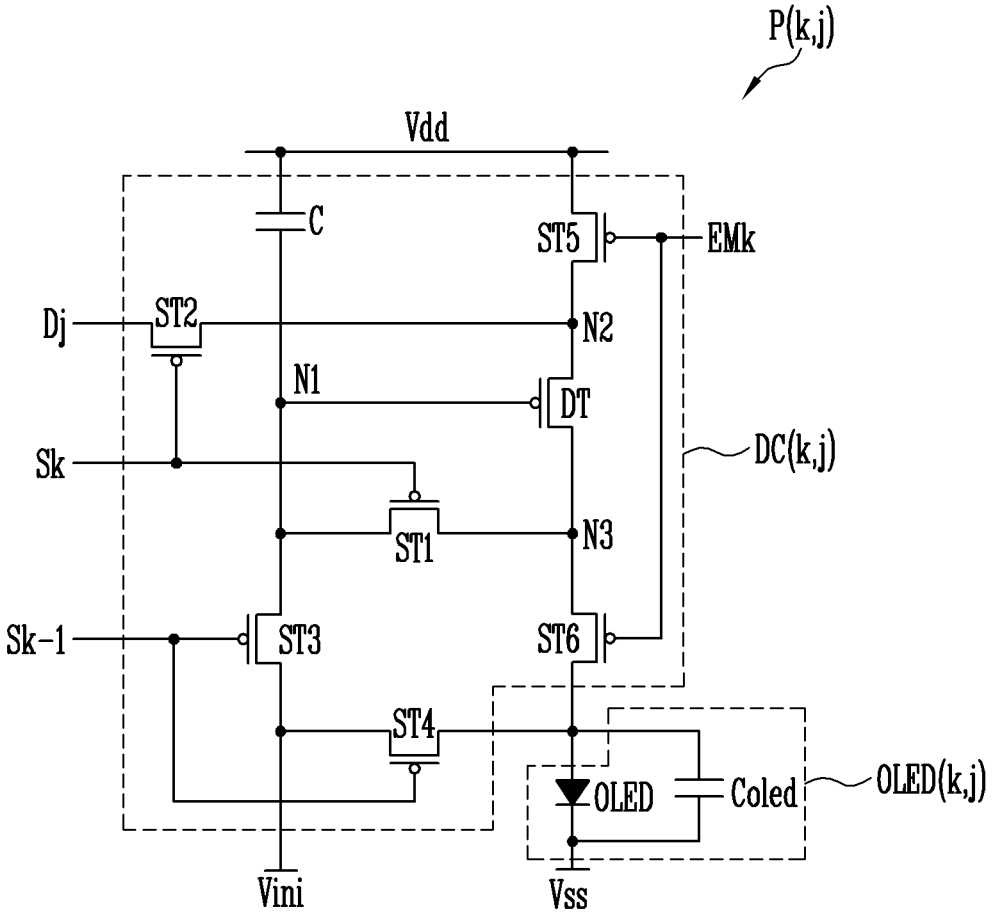
FIG. 3 is a diagram illustrating a pixel of the organic light emitting display device according to some exemplary embodiments of the present invention.

FIG. 3 is a diagram illustrating a pixel in the organic light emitting display device according to some exemplary embodiments of the present invention. Referring to FIG. 3, a pixel P(k,j) (k and j are positive integers) includes an organic light emitting diode OLED(k,j), and a pixel driving circuit DC(k,j) for outputting a driving current to the organic light emitting diode OLED(k,j). In FIG. 3, a $k^{th}$ light emission line EMk among the light emission lines, which is omitted in FIG. 1A, is illustrated. However, the present invention is not limited to the pixel shown in FIG. 3, and as understood by those skilled in the art, the pixel driving circuit may be implemented by a different structure and method from that illustrated in FIG. 3.

The pixel driving circuit DC(k,j) includes a driving transistor DT, first to sixth transistors ST1 to ST6, and a capacitor C.

A gate electrode of the driving transistor DT is connected to a first node N1, a first electrode thereof is connected to a second node N2, and a second electrode thereof is connected to a third node N3. The driving transistor DT controls a current between a drain and a source based on a difference in a voltage level between the gate electrode and the first electrode. A current level of the current $I_{ds}$ between the drain and the source corresponds to a current level of the driving current. Here, the first electrode may be a source electrode or a drain electrode, and the second electrode may be an electrode different from the first electrode. For example, when the first electrode is the source electrode, the second electrode may be the drain electrode. Definitions of the first electrode and the second electrode may be equally applied to the first to the sixth transistors ST1 to ST6.

A gate electrode of the first transistor ST1 is connected to a $k^{th}$ scan line Sk, a first electrode thereof is connected to the third node N3, and a second electrode thereof is connected to the first node N1. When the first transistor ST1 is turned on by a scan signal of the $k^{th}$ scan line Sk, the driving transistor DT is driven as a diode. In other words, the driving transistor DT is diode-connected.

A gate electrode of the second transistor ST2 is connected to the $k^{th}$ scan line Sk, a first electrode thereof is connected to a $j^{th}$ data line Dj, and a second electrode thereof is connected to the second node N2. When the second transistor ST2 is turned on by the scan signal of the $k^{th}$ scan line, a voltage level of the second node N2 corresponds to a voltage level of the data line Dj.

A gate electrode of the third transistor ST3 is connected to a $k-1^{th}$ scan line Sk−1, a first electrode thereof is connected to the first node N1, and a second electrode thereof receives an initialization power voltage Vini. When a scan signal is applied to the $k-1^{th}$ scan line Sk−1, the initialization power voltage Vini is applied to the first node N1.

A gate electrode of the fourth transistor ST4 is connected to the $k-1^{th}$ scan line Sk−1, a first electrode thereof receives the initialization power voltage Vini, and a second electrode thereof is connected to an anode electrode of the organic light emitting diode OLED(k,j). When a scan signal is applied to the $k-1^{th}$ scan line Sk−1, the initialization power voltage Vini is applied to the anode electrode of the organic light emitting diode OLED(k,j).

A gate electrode of the fifth transistor ST5 is connected to the $k^{th}$ light emission line EMk, a high potential voltage $V_{dd}$ is applied to a first electrode thereof, and a second electrode thereof is connected to the second node N2. When a light emission signal is applied to the $k^{th}$ light emission line EMk, the high potential voltage $V_{dd}$ is applied to the second node N2.

A gate electrode of the sixth transistor ST6 is connected to the $k^{th}$ light emission line EMk, a first electrode thereof is connected to the third node N3, and a second electrode thereof is connected to the anode electrode of the organic light emitting diode OLED(k,j). The fifth and sixth transistors ST5 and ST6 are turned on by the light emission signal of the $k^{th}$ light emission line EMk, and the current $I_{ds}$ between the drain and the source of the driving transistor DT is output to the organic light emitting diode OLED(k,j) as the driving current.

One end of the capacitor C is connected to the first node N1, the high potential voltage $V_{dd}$ is applied to the other end thereof, and the capacitor C maintains a voltage level of the first node N1.

A current level of the current $I_{ds}$ between the drain and the source of the driving transistor DT supplied to the organic light emitting diode OLED(k,j) may be expressed by Equation 1.

$$I_{ds}=k(V_{gs}-V_{th})^2 \quad \text{Equation 1}$$

In Equation 1, k refers to a proportional coefficient determined by a structure and a physical characteristic of the driving transistor, $V_{gs}$ refers to a voltage between the gate and the source of the driving transistor, and $V_{th}$ refers to a threshold voltage of the driving transistor.

The pixel driving circuit DC(k,j) illustrated in FIG. 3 is operated as described below.

When the scan signal is applied to the k−1th scan line Sk−1, the third and fourth transistors ST3 and ST4 are turned on, and the initialization power voltage Vini is applied to the first node N1 and the anode electrode of the organic light emitting diode OLED(k,j).

When the scan signal is applied to the kth scan line Sk, the third and fourth transistors ST3 and ST4 are turned off, and the first and second transistors ST1 and ST2 are turned on. The voltage level of the first node N1 corresponds to a voltage level of the third node N3, so that the driving transistor DT is driven as a diode (e.g., diode-connected). The voltage level of the second node N2 is determined as a voltage level $V_{jdata}$ of the data line Dj according to the turn-on of the second transistor ST2. In the driving transistor DT, a current path is formed and the voltage level VN1 of the first node N1 is increased, until a difference between the voltage level VN1 of the gate electrode (e.g., the voltage level of the first node N1) and the voltage level of the first electrode (e.g., the voltage level of the second node N2) VN2 reaches a threshold voltage $V_{th}$ of the driving transistor DT. When the voltage level VN1 of the first node N1 becomes the difference between the voltage $V_{jdata}$ of the data line Dj and the threshold voltage $V_{th}$ (e.g., $VN1=V_{jdata}-V_{th}$), the driving transistor DT is turned off, and the voltage level of the first node N1 is not increased any longer.

When the light emission signal is applied to the $k^{th}$ light emission line EMk, the first and second transistors ST1 and ST2 are turned off, and the fifth and sixth transistors ST5 and ST6 are turned on. The current $I_{ds}$ between the drain and the source of the driving transistor DT is applied to the organic light emitting diode OLED(k,j) by the turn-on of the fifth and sixth transistors ST5 and ST6. The voltage level of the first node N1 is a difference ($V_{jdata}-V_{th}$) between the voltage $V_{jdata}$ of the data line Dj and the threshold voltage $V_{th}$, and the high potential voltage $V_{dd}$ is applied to the second node N2. The current $I_{ds}$ between the drain and the source may be defined as Equation 2.

$$I_{ds}=k(V_{gs}-V_{th})^2=k\{(V_{dd}-(V_{jdata}-V_{th}))-V_{th}\}^2=k\{(V_{dd}-V_{jdata})\}^2 \quad \text{Equation 2}$$

As a result, the current $I_{ds}$ between the drain and the source of the driving transistor DT is not influenced by the threshold voltage $V_{th}$ of the driving transistor DT.

Figure 4A:
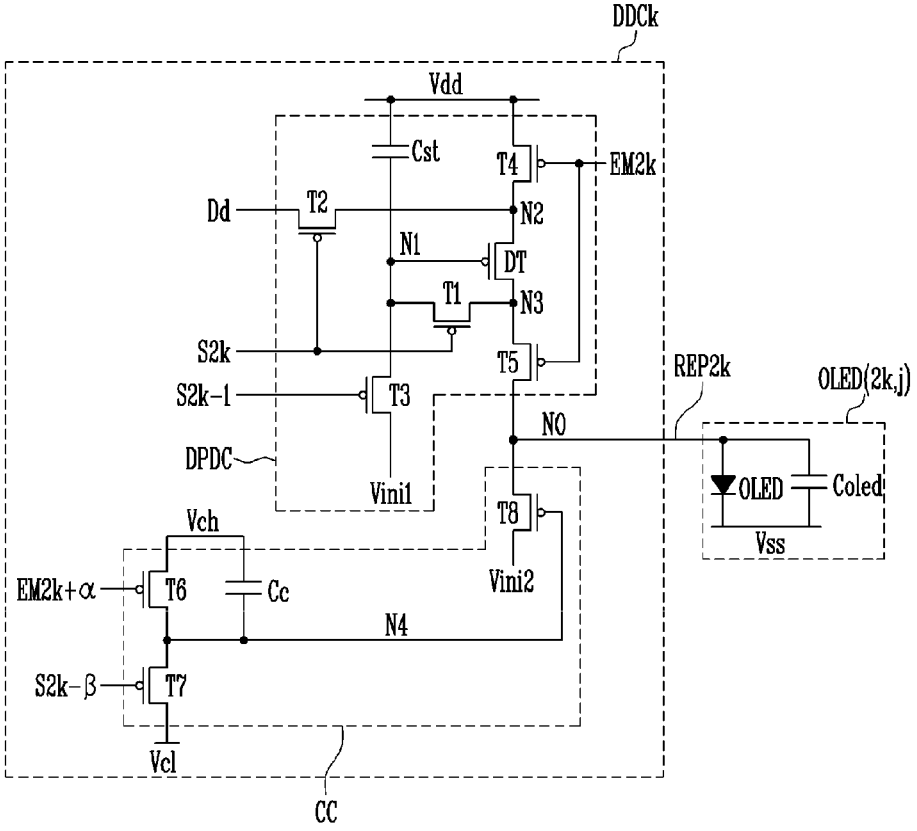
FIG. 4A is a diagram illustrating a case where a corresponding organic light emitting diode is connected to a $k^{th}$ dummy driving circuit through a $2k^{th}$ repair line in the organic light emitting display device according to some exemplary embodiments of the present invention.

FIG. 4A is a diagram illustrating a case where a corresponding organic light emitting diode is connected to a $k^{th}$ dummy driving circuit through a $2k^{th}$ repair line in the organic light emitting display device according to some exemplary embodiments of the present invention. In the exemplary embodiment illustrated in FIG. 4A, the case where the driving circuit DC(2*k*,*j*) within the organic light emitting display device illustrated in FIG. 1A is erroneously operated will be described. It is assumed that a corresponding organic light emitting diode OLED(2*k*,*j*) is electrically disconnected with an erroneously operated driving circuit DC(2*k*,*j*), and is electrically connected with a $2k^{th}$ repair line REP2*k*. The $2k^{th}$ repair line REP2*k* may be electrically connected with the $k^{th}$ dummy driving circuit DDCk through laser irradiation and the like. The $k^{th}$ dummy driving circuit DDCk includes a dummy pixel driving circuit DPDC, a compensation circuit CC, and an output node NO.

The dummy pixel driving circuit DPDC illustrated in FIG. 4A is substantially similar to the driving circuit DC(k,j) illustrated in FIG. 3. For example, a driving transistor DT, a first transistor T1, a second transistor T2, a third transistor T3, a fourth transistor T4, and a fifth transistor T5 within the dummy pixel driving circuit DPDC correspond to the driving transistor DT, the first transistor ST1, the second transistor ST2, the third transistor ST3, the fifth transistor ST5, and the sixth fifth transistor ST5 illustrated in FIG. 3, respectively, so that detailed descriptions thereof will be omitted.

In the pixel driving circuit DC(k,j) illustrated in FIG. 3, the second transistor ST2 is connected to the $j^{th}$ data line Dj, but in the dummy pixel driving circuit DPDC illustrated in FIG. 4A, the second transistor T2 is connected to a dummy data line Dd. Further, in the pixel driving circuit DC(k,j) illustrated in FIG. 3, the second electrode of the sixth transistor ST6 is connected to the anode electrode of the organic light emitting diode OLED(k,j), but in the dummy pixel driving circuit DPDC illustrated in FIG. 4A, a second electrode of the fifth transistor T5 is connected to the output node NO. The output node NO may be disposed so as to be electrically connected to a $2k^{th}$ repair line REP2*k*, and electrically connected to an anode electrode of the organic light emitting diode OLED(2*k*,*j*) through the $2k^{th}$ repair line REP2*k*. The organic light emitting diode OLED(2*k*,*j*) may emit light according to a dummy driving current output by the output node NO of a corresponding dummy driving circuit DDCk.

The compensation circuit CC includes sixth to eighth transistors T6 to T8, and a compensation capacitor Cc. In the pixel driving circuit DC(k,j) illustrated in FIG. 3, the initialization power voltage Vini is applied to the organic light emitting diode OLED(k,j) by the turn-on of the fourth transistor ST4, but in the compensation circuit Cc illustrated in FIG. 4, a second initialization power voltage Vini2 is applied to the output node NO by turn-on of the eighth transistor T8.

A gate electrode of the sixth transistor T6 is electrically connected to a $2k+\alpha^{th}$ light emission line EM2*k*+α (α is a positive integer), a high potential compensation voltage Vch is applied to a first electrode thereof, and a second electrode thereof is connected to a fourth node N4.

A gate electrode of the seventh transistor T7 is electrically connected to a $2k-\beta^{th}$ scan line S2*k*−β (β is a positive integer greater than or equal to 2), a first electrode thereof is connected to the fourth node N4, and a low potential compensation voltage Vcl is applied to a second electrode thereof.

A gate electrode of the eighth transistor T8 is connected to the fourth node N4, a first electrode thereof is connected to the output node NO, and the second initialization power voltage Vini2 is applied to a second electrode thereof.

One end of the compensation capacitor Cc is connected to the fourth node N4, and the high potential compensation voltage Vch is applied to the other end thereof.

The dummy pixel driving circuit DDCk illustrated in FIG. 4A is operated as described below. For convenience of the description, it is assumed that the driving circuit DC(2*k*,*j*) is erroneously operated. It is assumed that the output node NO of the corresponding dummy pixel driving circuit DDCk is electrically connected to the corresponding organic light emitting diode OLED(2*k*,*j*) through the $2k^{th}$ repair line REP2*k*.

When a scan signal is applied to a $2k-\beta^{th}$ scan line S2*k*−β, the seventh transistor T7 is turned on, and the low potential compensation voltage Vcl is applied to the fourth node N4. Since the low potential compensation voltage Vcl may turn on the eighth transistor T8, the second initialization power voltage Vini2 is applied to the output node NO. Then, even though the application of the scan signal to the $2k-\beta^{th}$ scan line S$2k-\beta$ is stopped, a voltage level of the fourth node N4 is not varied, until a light emission signal is applied to the $2k+\alpha^{th}$ light emission line EM$2k+\alpha$.

Then, when the scan signal is applied to the $2k-1^{th}$ scan line S$2k-1$, the seventh transistor T7 is turned off, and the third transistor T3 is turned on. The third transistor T3 is turned on, so that the first initialization power voltage Vini1 is applied to the first node N1.

When the scan signal is applied to the $2k^{th}$ scan line S$2k$, the third transistor T3 is turned off, and the first and second transistors T1 and T2 are turned on. The first and second transistors T1 and T2 are turned on, so that a dummy data voltage is input to the second node N2. A voltage level of the second node N2 is determined as a voltage level $V_{ddata}$ of the dummy data voltage.

When the light emission signal is applied to the $2k^{th}$ light emission line EM$2k$, the fourth and fifth transistors T4 and T5 are turned on. A current level applied to an anode electrode of the corresponding organic light emitting diode OLED($2k,j$) may be momentarily greater than the current level $I_{ds}$ between the drain and the source of the driving transistor DT by parasitic capacitance associated with the repair line REP$2k$, and the organic light emitting diode OLED($2k,j$) may erroneously emit light. However, since the eighth transistor T8 is in the turn-on state, at least a part of the current increasing by the parasitic capacitance passes through the eighth transistor T8. Accordingly, the organic light emitting diode OLED($2k,j$) may not be influenced by the momentarily increasing current level. Otherwise, the second initialization voltage Vini2 is applied to the anode electrode of the organic light emitting diode OLED ($2k,j$) during the turn-on of the eighth transistor T8, so that the organic light emitting diode OLED ($2k,j$) may not emit light.

After the phenomenon in which the current level momentarily increases by the parasitic capacitance sufficiently disappears, the light emission signal is input to the $2k+\alpha^{th}$ light emission line EM$2k+\alpha$. Since the sixth transistor T6 is in the turn-on state, and the seventh transistor T7 is in the turn-off state, the voltage level of the fourth node N4 is changed to the high potential compensation voltage Vch. Since the high potential compensation voltage Vch is applied to the fourth node N4, the eighth transistor T8 is turned off, and the current Ids between the drain and the source of the driving transistor DT flows (e.g., completely flows) to the organic light emitting diode OLED($2k,j$).

The input of the light emission signal to the $2k+\alpha^{th}$ light emission line EM$2k+\alpha$ may be stopped after a sufficient time, but the voltage level is maintained by the compensation capacitor Cc.

Figure 4B:
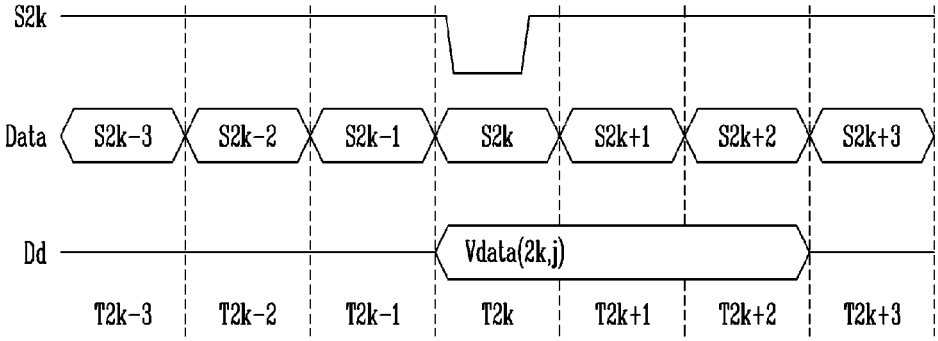
FIG. 4B is a diagram illustrating a change according to a time of signals supplied to a corresponding dummy driving circuit and data supplied to a pixel in the organic light emitting display device illustrated in FIG. 4A.

FIG. 4B is a diagram illustrating a change according to a time of signals supplied to a corresponding dummy driving circuit and data supplied to a pixel in the organic light emitting display device illustrated in FIG. 4A. Referring to FIG. 4B, a data voltage is applied to the data lines D1 to Dn at a timing T$2k$ at which the scan signal is supplied to the $2k^{th}$ scan line S$2k$. Since the driving circuit DC($2k,j$) is erroneously operated, the dummy data line Dd outputs a voltage Vdata($2k,j$), which is to be supplied to the pixel P($2k,j$), at the timing T$2k$ under the control of the controller of the organic light emitting display device. When the dummy data line Dd outputs (e.g., continuously outputs) the voltage Vdata($2k,j$) even after a timing T$2k+1$ at which the supply of the scan signal to the $2k^{th}$ scan line S$2k$ is stopped, this may influence the driving of another pixel. Accordingly, when an amount of time (e.g., a predetermined amount of time) elapses after the application of the scan signal to the $2k^{th}$ scan line S$2k$ is ended, the voltage level of the dummy data voltage may be a voltage level (hereinafter, a black voltage level), at which light is not emitted, or the dummy data line Dd may be floated. In the example illustrated in FIG. 4B, an output of the voltage Vdata($2k,j$) is stopped at a timing T$2k+3$, at which the scan signal is applied to a $2k+3^{th}$ scan line S$2k+3$. While, when the organic light emitting diode OLED($2k,j$) is driven by the driving circuit DC($2k,j$), the organic light emitting diode OLED($2k,j$) emits light after the light emission signal is applied to the $2k^{th}$ light emission line EM$2k$, when the organic light emitting diode OLED($2k,j$) is driven by the $k^{th}$ dummy driving circuit DDCk, the organic light emitting diode OLED($2k,j$) may emit light after the light emission signal is applied to the $2k+\alpha^{th}$ light emission line EM$2k+\alpha$. A timing, at which the organic light emitting diode OLED($2k,j$) starts to emit light, is delayed, but the delayed time is sufficiently shorter than a time for which one frame is displayed, so that the delayed time may not be identified with naked eyes.

Figure 5A:
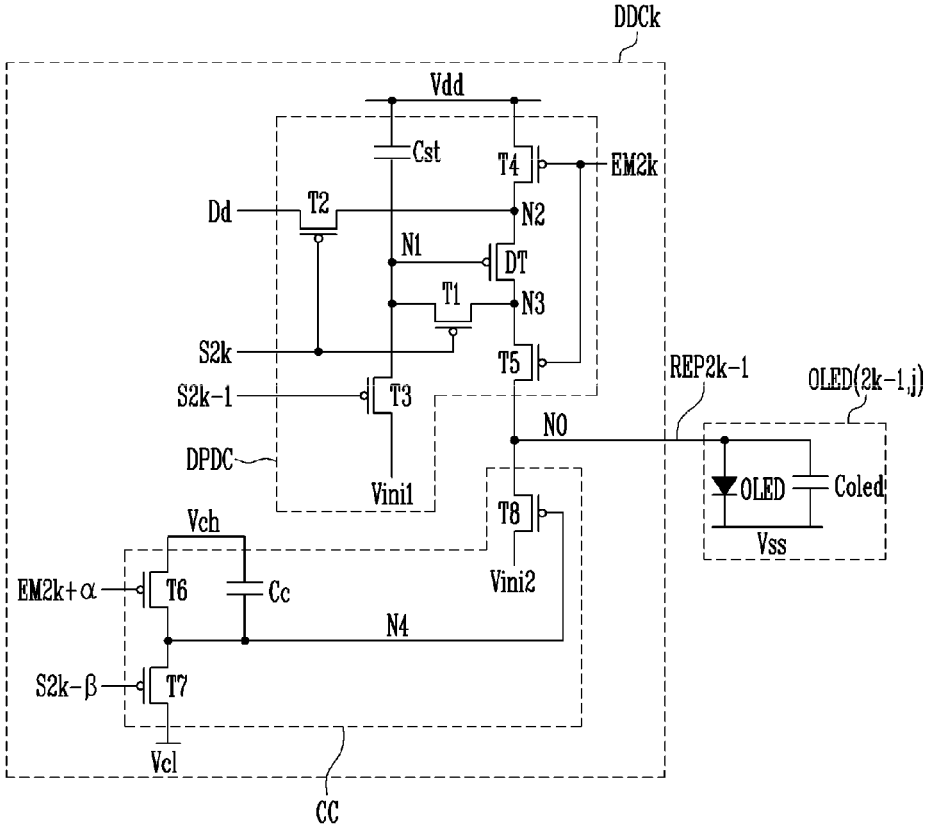
FIG. 5A is a diagram illustrating a case where a corresponding organic light emitting diode is connected to a $k^{th}$ dummy driving circuit through a $2k-1^{th}$ repair line in the organic light emitting display device according to some exemplary embodiments of the present invention.
Figure 5B:
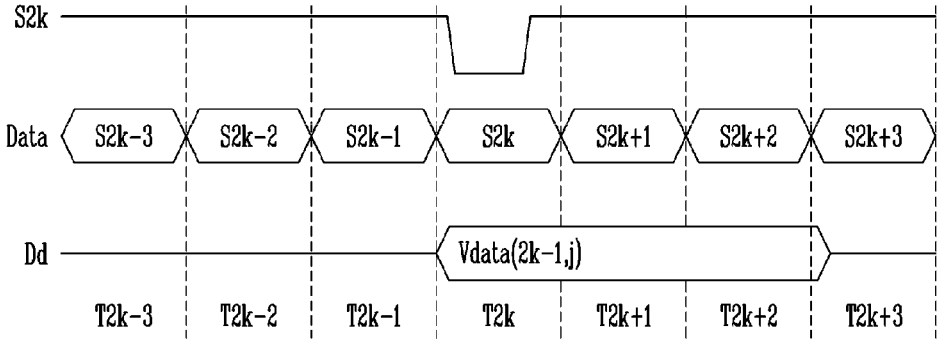
FIG. 5B is a diagram illustrating a change according to a time of signals supplied to a corresponding dummy driving circuit and data supplied to a pixel in the organic light emitting display device illustrated in FIG. 5A.

FIG. 5A is a diagram illustrating a case where a corresponding organic light emitting diode is connected to a $k^{th}$ dummy driving circuit through a $2k-1^{th}$ repair line in the organic light emitting display device according to some exemplary embodiments of the present invention. In the exemplary embodiment illustrated in FIG. 5A, the case where a driving circuit DC($2k-1$,j) within the organic light emitting display device illustrated in FIG. 1A is erroneously operated will be described. An operation of the $k^{th}$ dummy pixel driving circuit DDCk has been described with reference to FIG. 4A, so description thereof will be omitted. FIG. 5A is substantially similar to FIG. 4A, but is different in that the $k^{th}$ dummy driving circuit DDCk is electrically connected with an organic light emitting diode OLED($2k-1$,j) through a $2k-1^{th}$ repair line REP$2k-1$. The dummy data line Dd outputs a voltage Vdata($2k-1$,j), which is to be supplied to a pixel P($2k-1$,j), at the timing T$2k$ under the control of the controller of the organic light emitting display device.

While, when the organic light emitting diode OLED($2k-1$,j) is driven by the driving circuit DC($2k-1$,j), the organic light emitting diode OLED($2k-1$,j) emits light after the light emission signal is applied to the $2k-1^{th}$ light emission line EM$2k-1$, when the organic light emitting diode OLED($2k-1$,j) is driven by the $k^{th}$ dummy driving circuit DDCk, the organic light emitting diode OLED($2k-1$,j) may emit light after the light emission signal is applied to the $2k+\alpha^{th}$ light emission line EM$2k+\alpha$. The timing, at which the organic light emitting diode OLED($2k-1$,j) starts to emit light, and the delayed time is longer than the delayed time in the exemplary embodiment illustrated in FIG. 4A, but the delayed time is sufficiently shorter than a time for which one frame is displayed, so that the delayed time may not be identified with naked eyes.

By way of summation and review, a defect may be generated in the pixel driving circuit during a process of fabricating the organic light emitting display device. Accordingly, yield of the organic light emitting display device may deteriorate, and fabricating costs of the organic light emitting display device may increase.

The organic light emitting display device according to some exemplary embodiments of the present invention may repair an erroneously operated pixel driving circuit, while using a relatively small space.

Some example embodiments have been disclosed herein, and although specific terms are employed, they are used and are to be interpreted in a generic and descriptive sense only, and not for purposes of limitation. In some instances, as would be appreciated by one of ordinary skill in the art as of the filing of the present application, features, characteristics, and/or elements described in connection with a particular embodiment may be used singly or in combination with features, characteristics, and/or elements described in connection with other embodiments, unless otherwise specifically indicated. Accordingly, it will be understood by those of skill in the art that various changes in form and details may be made without departing from the spirit and scope of the present invention as set forth in the following claims, and their equivalents.

What is claimed is:

1. An organic light emitting display device, comprising:

scan lines, light emission lines, and data lines crossing the scan lines and the light emission lines;

a plurality of pixels connected to the scan lines, the light emission lines, and the data lines, the plurality of pixels comprising organic light emitting diodes, and pixel driving circuits configured to output a driving current to the organic light emitting diodes, respectively;

a plurality of dummy driving circuits configured to output a dummy driving current;

a dummy data line configured to apply a dummy data voltage to the plurality of dummy driving circuits; and a plurality of repair lines configured to electrically connect each of the organic light emitting diodes to at least one of the plurality of dummy driving circuits, wherein each of the dummy driving circuits corresponds to at least two of the repair lines, and each of the organic light emitting diodes is configured to be electrically connected to corresponding ones of the dummy driving circuits through corresponding ones of the repair lines, wherein a corresponding organic light emitting diode is electrically disconnected from an erroneously operated pixel driving circuit, the corresponding organic light emitting diode is electrically connected to a corresponding dummy driving circuit via a corresponding repair line, the corresponding organic light emitting diode is configured to emit light according to a dummy driving current output by the corresponding dummy driving circuit, and the corresponding repair line and the corresponding dummy driving circuit are electrically connected to each other by laser irradiation.

2. The organic light emitting display device of claim 1, wherein the plurality of repair lines corresponds to the scan lines, respectively, and the at least two of the repair lines corresponding to each of the dummy driving circuits is adjacent to each other.

3. The organic light emitting display device of claim 2, wherein each of the dummy driving circuits is configured to receive the dummy data voltage at one timing from among timings during which a scan signal is applied to corresponding ones of the scan lines, and a voltage level of the dummy data voltage corresponds to a voltage level of a data line electrically connected to an erroneously operated pixel driving circuit.

4. The organic light emitting display device of claim 2, wherein each of the dummy driving circuits is configured to receive the dummy data voltage at a last timing from among timings during which a scan signal is applied to corresponding ones of the scan lines, and a current level of the dummy driving current corresponds to a voltage level of the dummy data voltage.

5. The organic light emitting display device of claim 1, wherein the dummy data line is configured to be floated, or to apply a dummy data voltage having a black voltage level, at which light emission by the corresponding organic light emitting diode is stopped, to the corresponding dummy driving circuit, after the corresponding dummy driving circuit outputs the dummy driving current to the corresponding organic light emitting diode.

6. The organic light emitting display device of claim 1, wherein one of the organic light emitting diodes is configured to emit light corresponding to the dummy data voltage from the dummy data line, when the one of the organic light emitting diodes is electrically connected to one of the dummy driving circuits through a corresponding one of the repair lines.

7. An organic light emitting display device, comprising:

scan lines, light emission lines, and data lines crossing the scan lines and the light emission lines;

a plurality of pixels connected to the scan lines, the light emission lines, and the data lines, the plurality of pixels comprising organic light emitting diodes, and pixel driving circuits configured to output a driving current to the organic light emitting diodes, respectively;

a plurality of dummy driving circuits configured to output a dummy driving current;

a dummy data line configured to apply a dummy data voltage to the plurality of dummy driving circuits; and a plurality of repair lines configured to electrically connect each of the organic light emitting diodes to at least one of the plurality of dummy driving circuits, wherein each of the dummy driving circuits corresponds to at least two of the repair lines, and each of the organic light emitting diodes is configured to be electrically connected to corresponding ones of the dummy driving circuits through corresponding ones of the repair lines, wherein each of the dummy driving circuits corresponds to two of the repair lines, and each of the dummy driving circuits comprises:

a dummy pixel driving circuit configured to output a current of which a level corresponds to a voltage level of the dummy data voltage;

a compensation circuit configured to compensate for a current variation by parasitic capacitance by corresponding ones of the repair lines; and an output node configured to output the dummy driving current, wherein the output node is electrically connected to the dummy pixel driving circuit and the compensation circuit.

8. The organic light emitting display device of claim 7, wherein the dummy pixel driving circuit comprises:

a driving transistor comprising a gate electrode connected to a first node, a first electrode connected to a second node, and a second electrode connected to a third node;

a first transistor comprising a gate electrode connected to a first scan line from among the scan lines, a first electrode connected to the first node, and a second electrode connected to the third node;

a second transistor comprising a gate electrode connected to the first scan line, a first electrode connected to the dummy data line, and a second electrode connected to the second node;

a third transistor comprising a gate electrode connected to a second scan line from among the scan lines, a first electrode connected to the first node, and a second electrode configured to receive a first initialization power voltage;

a fourth transistor comprising a gate electrode connected to a first light emission line from among the light emission lines, a first electrode configured to receive a high potential voltage, and a second electrode connected to the second node;

a fifth transistor comprising a gate electrode connected to the first light emission line, a first electrode connected to the third node, and a second electrode connected to the output node; and a capacitor comprising one end connected to the first node, and another end configured to receive the high potential voltage, wherein the first light emission line corresponds to the first scan line, and a scan signal is applied to the first scan line after the scan signal is applied to the second scan line.

9. The organic light emitting display device of claim 8, wherein the compensation circuit comprises:

a sixth transistor comprising a gate electrode connected to a third light emission line from among the light emission lines, a first electrode configured to receive a high potential compensation voltage, and a second electrode connected to a fifth node;

a seventh transistor comprising a gate electrode connected to a third scan line from among the scan lines, a first electrode connected to the fifth node, and a second electrode configured to receive a low potential compensation voltage;

an eighth transistor comprising a gate electrode connected to the fifth node, a first electrode connected to the output node, and a second electrode configured to receive a second initialization power voltage; and a compensation capacitor comprising one end connected to the fifth node, and another end configured to receive the high potential compensation voltage, wherein a light emission signal is applied to the third light emission line after the light emission signal is applied to a light emission line electrically connected to a corresponding dummy pixel driving circuit, and a scan signal is applied to a scan line electrically connected to the corresponding dummy pixel driving circuit after the scan signal is applied to the third scan line.

10. The organic light emitting display device of claim 8, wherein the first scan line corresponds to a repair line from among the repair lines to which the scan signal is applied last within one frame.

* * * * *